US006223567B1

(12) United States Patent
Fadul

(10) Patent No.: US 6,223,567 B1
(45) Date of Patent: May 1, 2001

(54) DOOR LOCK WITH CLUTCH ARRANGEMENT

(75) Inventor: Cedric Q. Fadul, Los Angeles, CA (US)

(73) Assignee: NT Falcon Lock, Brea, CA (US)

( * ) Notice: Subject to any disclaimer, the term of this patent is extended or adjusted under 35 U.S.C. 154(b) by 0 days.

(21) Appl. No.: 09/321,970

(22) Filed: May 28, 1999

Related U.S. Application Data

(63) Continuation-in-part of application No. 08/374,415, filed on Jan. 19, 1995, now Pat. No. 5,992,189, and a continuation-in-part of application No. 08/976,077, filed on Nov. 21, 1997, now Pat. No. 6,021,654, which is a division of application No. 08/374,415.

(51) Int. Cl.[7] ..... E05B 55/06

(52) U.S. Cl. ..... 70/149; 70/224; 70/277; 70/472

(58) Field of Search ..... 70/149, 277–283, 70/218, 221–224, 467, 468, 471–473, 476, 477, 481, 482; 292/336.3, 357, 359, DIG. 30, DIG. 37

(56) References Cited

U.S. PATENT DOCUMENTS 4,631,944 * 12/1986 Gater et al. ..... 70/149 X
4,920,773 * 5/1990 Surko, Jr. ..... 70/149 X
5,018,375 * 5/1991 Tully ..... 70/283 X
5,372,025 * 12/1994 Lin ..... 70/472
5,421,178 * 6/1995 Hamel et al. ..... 70/277 X
5,447,047 * 9/1995 Lin ..... 70/277 X
5,481,890 * 1/1996 Millman ..... 70/224
5,544,507 * 8/1996 Lin ..... 70/277 X
5,628,216 * 5/1997 Qureshi et al. ..... 70/279
5,694,798 * 12/1997 Nunez et al. ..... 70/224 X
5,768,926 * 6/1998 Shen ..... 70/149 X
5,782,118 * 7/1998 Chamberlain et al. ..... 70/279
5,868,018 * 2/1999 Kang ..... 70/224 X
5,934,117 * 8/1999 Shen ..... 70/149 X
5,992,189 * 11/1999 McCaa ..... 70/149
6,014,878 * 1/2000 Shen ..... 70/472
6,021,654 * 2/2000 McCaa ..... 70/149

* cited by examiner

*Primary Examiner*—Suzanne Dino Barrett
(74) *Attorney, Agent, or Firm*—Don Finkelstein

(57) ABSTRACT

A lock arrangement having a driver element which has two outer surface sections. The first section has a first geometrical cross-section configuration which engages an outer lever spindle in both the locked and unlocked condition. In the unlocked condition, the first section also engages an outer driver spindle which rotates with the outer lever handle and outer lever spindle and engages the latch retraction structure for retraction of the latch. In the locked position, the second outer surface section of the driver element is aligned with outer drive spindle and the second surface section is free of driving engagement with the outer drive spindle such that retraction of the latch is prevented when the outer lever handle is rotated. A solenoid is provided on the interior of the lock and controls the movement of the driver element between the locked and unlocked positions.

15 Claims, 13 Drawing Sheets

DOOR LOCK WITH CLUTCH ARRANGEMENT

REFERENCE TO RELATED APPLICATIONS

This application is a continuation in part of application Ser. No.08/374,415 filed Jan. 19, 1995 now U.S. Pat. No. 5,992,189 and of application Ser. No.08/976,077, filed Nov. 21, 1997 now U.S. Pat. No. 6,021,654, which is a division of serial No. 08/374,415.

BACKGROUND OF THE INVENTION

1. Field of the Invention

This invention relates to a lock arrangement in which a declutching mechanism is provided so that in the locked position rotation of the outer handle does not cause actuation and retraction of the latch.

2. Description of the Prior Art

In many of the prior art lock devices, there is incorporated a clutch mechanism by which the latch may be disengaged by manipulation of the inner handle so that the outer handle may be free to rotate when the clutch is disengaged without retraction of the latch. Such arrangements have not, in many instances, proven to be sufficiently strong enough in their operation to withstand comparatively heavy rotational forces on the outer handle. In particular, when the outer handle is a lever as now often required under various state and federal laws in the United States for handicapped access, the forces can be considerable depending upon the length of the lever.

Examples of such declutching mechanisms are shown, for example, in U.S. Pat. No. 4,920,773 in which a declutching mechanism is utilized in connection with a lever handle lock.

Other examples of the prior art patents are shown in, for example, U.S. Pat. No. 2,634,598. Additionally, other examples of prior art lock arrangements are shown in:

| Inventor | U.S. Pat. No. | Issue Date |
|---|---|---|
| J. A. Rymer | 1,834,223 | 12/01/31 |
| W. F. Nelson | 2,062,598 | 12/01/36 |
| K. A. Brauning | 2,175,791 | 10/10/39 |
| R. F. Peo | 2,197,508 | 04/16/40 |
| F. K. Heyer | 2,672,041 | 03/16/54 |
| Tornoe et al. | 3,718,015 | 02/27/73 |
| Tornoe et al. | 3,856,339 | 12/24/74 |
| Tranberg et al. | 3,881,331 | 05/96/75 |
| Nagy et al. | 3,896,644 | 07/29/75 |
| Kagoura | 3,922,896 | 12/02/75 |
| Dietrich et al. | 4,108,482 | 08/22/78 |
| Dietrich et al. | 4,333,324 | 06/08/82 |
| Kambic | 4,429,556 | 02/07/84 |
| Foshee | 4,437,695 | 03/20/84 |
| Gater et al. | 4,631,944 | 12/30/86 |
| Martin et al. | 4,648,639 | 03/10/87 |
| Best et al. | 4,655,059 | 04/07/87 |
| Huang et al. | 4,660,395 | 04/28/87 |
| Gater et al. | 4,672,829 | 06/16/87 |
| Lin | 5,372,025 | 12/13/94 |

No exhaustive search of the prior art has been done.

SUMMARY OF THE INVENTION

As described in the above mentioned co-pending applications, there has long been a need for an improved lock arrangement in which a comparatively sturdy declutching mechanism is provided that allows driving engagement with the outer handle for retracting the latch for the lock in the unlocked position and prevents retraction of the latch upon operation of the outer handle when the lock is in the locked position. Such structure must be sufficiently strong to withstand comparatively high forces.

In accordance with the principles of the invention described in the above mentioned co-pending applications in a first preferred embodiment, there is provided a lock arrangement which has an inner handle which in preferred embodiments of the present invention, is an inner lever which is adapted to rotate about a first axis. The first axis extends longitudinally through the lock arrangement. In the first preferred embodiment there is a push button concentrically mounted on the first axis within the inner lever. The push button moves both reciprocatingly along the first axis and rotates about the first axis. In a second preferred embodiment of the invention described in the above mentioned co-pending applications the push button moves reciprocatingly along the first axis but does not rotate. In yet another preferred embodiment, described in the above mentioned co-pending applications there is no push button mounted on the inner lever. While such push button operations of lock arrangements are well known in the art, in the embodiments of the invention described in the above mentioned co-pending applications, having a push button, the push button is attached to a dogging bar which extends along the interior of the lock arrangement towards the outer lever and the dogging bar may rotate and reciprocate with the push button or only reciprocate with the push button. In the first and second preferred embodiments, for the push button pressed in a direction towards the outer handle the lock arrangement is in the locked position. For the push button retracted in a direction away from the outer handle the lock arrangement is in the unlocked position. Detents are provided to restrain the push button and dogging bar in the locked position. The detents engage the walls of a catch and the catch is spring biased towards the engagement with the detents in the dogging bar.

The outer handle, which in preferred embodiments of the present invention is a lever, is connected to an outer lever spindle which rotates about the first axis for rotation of the outer handle about the first axis. The outer lever spindle is generally tubular in shape and has an inner section having a radially inwardly-directed tab portion having internal walls concentric with the first axis and the internal walls having a first predetermined geometric configuration.

Concentrically mounted within the tab portion of the outer lever spindle is a driver. The driver has a first end positioned towards the outer handle and a second end positioned towards the inner handle. In preferred embodiments of the invention described in the above mentioned co-pending applications the driver is tubular in shape and has a first section on the outer surface thereof having the first predetermined geometric configuration in cross-section to match the cross-sectional configuration of the tab portion of the outer lever spindle. The first portion extends from the first end of the driver a preselected distance towards the second end of the driver.

The driver also has a second portion on the outer surface thereof and the second portion has a radial extent less than the first portion.

In preferred embodiments of the invention described in the above mentioned co-pending applications, the second portion of the outer surface of the driver has a second geometric configuration and cross-section which is different from the first portion. In preferred embodiments of the invention described in the above mentioned co-pending applications the first portion of the outer surface of the driver may, for example, be square and the second portion of the outer surface of the driver may, for example, be round. However, other geometrical configurations may be selected depending upon the application. In the above-described embodiment and in other embodiments with such other configurations, it is, of course, necessary that the second portion of the outer surface of the driver be configured so as to be free of driving engagement with the tab portion on the outer driver spindle. The second end of the driver has a flanged portion extending radially outwardly from the second portion. A push cup or push cap has a first end positioned against the flange portion of the driver and extends axially towards the inner handle and has a second end engaging the dogging bar. The push cup, in preferred embodiments of the present invention is generally tubular and is concentrically mounted about the first axis for reciprocating movement therealong.

A generally tubular outer drive spindle is coaxially mounted around the outer surface of the push cup and the outer drive spindle has a first end having an inwardly directed tab portion which has an internal surface having the first preselected geometric cross-section as the tab portion of the outer lever spindle and the first portion of the outer surface of the driver. The tab portion of the outer drive spindle is axially adjacent the tab portion of the outer lever spindle and, for the lock in the unlocked position the first portion of the outer surface of the driver engages both the tab portion of the outer lever spindle and the outer driver spindle. Rotation of the outer handle causes the tab portion of the outer lever spindle to engage the first portion of the outer surface of the driver to rotate the driver about the first axis. In the unlocked condition of the lock, rotation of the driver causes the first portion of the outer surface of the driver to engage the tab portion of the outer drive spindle. A second end of the outer drive spindle has a flange portion for engaging the latch mechanism to retract the latch.

A resilient means is positioned between the flange at the second end of the driver and the tab portion of the outer drive spindle. The resilient means, which may be a spring, biases the lock in the unlocked position. Actuation of the push button from the unlocked position axially inwardly towards the outer handle causes the dogging bar to move the push cup in an axial direction toward the outer handle which, in turn, moves the driver against the resiliency of the spring and positions the second portion of the outer surface of the driver into alignment with the tab portion of the outer drive spindle. The second portion of the outer surface of the driver is, as noted above, free of engagement with the tab portion of the outer drive spindle in the locked position. For the lock in the locked position, rotation of the outer handle causes rotation of the driver without rotation of the outer drive spindle. In the unlocked position the driver is moved so that the first portion of the surface thereof engages both the tab portion of the outer lever spindle and the outer drive spindle to cause unlatching of the latch.

In the first preferred embodiment described in the above mentioned co-pending applications, the push button may move independently of the inner lever from the unlocked to the locked position. For the condition of the push button in the locked position, subsequent rotation of the push button rotates the detents on the dogging bar away from engagement with the walls of the catch. For the condition of the detents free of locking engagement with the catch, the dogging bar and the push button move in a direction away from the outer lever. Rotation of the inner lever for the push button in either the locked or unlocked position causes retraction of the latch so that the door may be opened from the inside with the dogging bar still in the locked position and the detents engaging the walls of the catch, upon the door being closed it is still locked and cannot be opened from outside by only operation of the outer lever. In the second preferred embodiment of the invention described in the above mentioned co-pending applications the push button and dogging bar move reciprocatingly along the first axis independently of the inner lever but are operatively connected to the inner lever for rotation therewith. In this second embodiment for the condition of the detents in the dogging bar engaging the walls of the catch, rotation of the inner lever rotates the dogging bar so that the detents are free of the walls of the catch. The dogging bar and button move in a direction away from the outer lever. The rotation at the inner lever also causes retraction of the latch so that the door may be opened from the inside. However, in this second preferred embodiment, since the dogging bar and button are in the unlocked condition, after the door is closed the door may be opened by rotation of the outer lever. To provide locking of the door, the push button must be actuated to return the dogging bar so that the detents again engage the walls of the catch to restrain the dogging bar in the locked position.

In both the first and second preferred embodiments described in the above mentioned co-pending applications, for the push button and dogging bar in the locked condition, the dogging bar has pushed the push cup against the driver so that the driver has moved axially towards the outer lever and the driver is free of driving engagement with the outer drive spindle. The door cannot be unlocked from the outside by only rotation of the outer lever in this condition.

In preferred embodiments of the invention described in the above mentioned co-pending applications a conventional key-operated cylinder lock is mounted within the outer handle and the cylinder lock has a tail piece extending substantially along the first axis interior of the outer drive spindle and push cup. In such an embodiment a key spindle which is generally tubular in shape is rotatably mounted for rotation about the first axis and is positioned intermediate the drive spindle and push cap. The key spindle has radially extending tab portions extending within the push cap and the push cap has a split at its first end to have axially-extending prongs on its first end extending through the key spindle for engagement with the driver. Upon actuation of the key cylinder the tail piece is rotated and engages the tabs on the key spindle. The interior end of the key spindle has a flange engaging the latch for retraction of the latch upon rotation of the key spindle. It will be appreciated, however, that such key spindle may be omitted and, in such an embodiment, the driver and push cap may be of solid construction rather than tubular.

In yet another embodiment of the invention described in the above mentioned co-pending applications the push cap, push button and dogging bar structure are omitted. In such an embodiment the rotation of the inner lever always causes the retraction of the latch so that the door may be opened. The tail piece of the key operated cylinder lock mounted in the outer lever engages a cam to rotate the cam as the key is turned. A cam follower bears against the cam face of the cam. The resilient means positioned between the flange on the driver and the tab portion of the outer drive spindle provide a spring bias of the driver and cam against the cam follower. In the locked condition, the driver and the cam are positioned towards the outer lever and the second portion of the outer surface of the driver is aligned with the tab portion of the outer drive spindle and rotation of the outer lever does not rotate the outer drive spindle and the door remains locked. The cam follower engages detents on the cam face. As the driver and cam are rotated by the tail piece of the key operated cylinder the cam moves down along the cam follower and the driver moves toward the inner lever. For the cam follower at the bottom of the cam face, the first portion of the outer surface of the driver is aligned with the tab portion of the outer drive spindle. In this position, rotation of the outer lever rotates the door lever spindle which rotates the driver and the driver rotates the outer drive spindle causing retraction of the latch. In another embodiment, similar to the cam and cam follower arrangement described above, the position of the cam and cam follower are reversed. The operation of such an embodiment is similar to that described above.

Another embodiment of the invention described in the above mentioned co-pending applications invention has particular use in bathrooms where it is desired to allow locking from the inside but also unlocking from the outside even though the inside is in a locked condition. Such applications allow, for example, opening of the door from the outside when the person inside, such as a child, is unable to unlock the door. In such an embodiment, the key cylinder may be replaced by a slotted button, or a push turn button engaging the tail piece which may be similar to the key cylinder tail piece.

However, the tail piece may be moved to extend through the driver and into the push cap for engagement with the dogging bar. The reciprocating movement of the outer button and tail piece and the rotation of the outer button causes rotation of the dogging bar and unlocks the door.

In other embodiments of the invention as described herein, certain modifications are made to the structure of the push/turn button configuration to provide an enhanced operational design. In such other embodiments, the basic structure and the basic operation is as described in the above mentioned co-pending applications.

However, according to the principals of the invention described herein, in an embodiment which did not include an inner push/turn or turn button, it has been found that a solenoid may be incorporated in the inner handle structure to actuate the driver. Two variations of such an embodiment have proven to be useful in various applications. In one embodiment termed a fail safe embodiment, the lock is normally in the unlocked condition wherein the first portion of the outer surface of the driver engages both the tab portions of the outer lever spindle and the outer drive spindle. In such condition, rotation of the outer lever handle rotates the outer lever spindle and thus rotates the outer drive spindle to cause the latch to retract. Application of power to the solenoid pushes the solenoid push rod outwardly to move the driver so that the first portion of the outer surface of the driver no longer is in engagement with the outer drive spindle and the lock is in the locked condition. In the locked condition, rotation of the outer handle only rotates the outer lever spindle and the outer drive spindle does not rotate. A conventional key operated cylinder may be incorporated in the outer handle so that insertion of the key allows unlocking of the door for the condition of the solenoid being powered.

In a second embodiment of the invention described herein, termed a fail secure embodiment, the lock is normally in the locked condition wherein the first portion of the outer surface of the driver is not engaged with the outer drive spindle and rotation of the outer lever only rotates the outer lever spindle and does not unlock the lock. Application of power to the solenoid causes the solenoid to retract the solenoid push rod and a spring moves the driver towards the inner handle and places the first portion of the outer surface of the driver into engagement with the tab on the outer drive spindle and such condition is the unlocked condition of the lock. In the unlocked condition, rotation of the outer handle rotates the outer lever spindle which rotates the driver and thus causes rotation of the outer drive spindle to cause retraction of the latch. In the fail secure embodiment, a conventional key cylinder may be incorporated into the outer handle to allow unlocking of the lock when it is in the locked condition.

BRIEF DESCRIPTION OF THE DRAWINGS

The above and other embodiments of the invention may be more fully understood from the following detained description taken together with the accompanying drawing wherein similar reference characters refer to similar elements throughout and in which.

DESCRIPTION OF THE PREFERRED EMBODIMENTS

Figure 1:
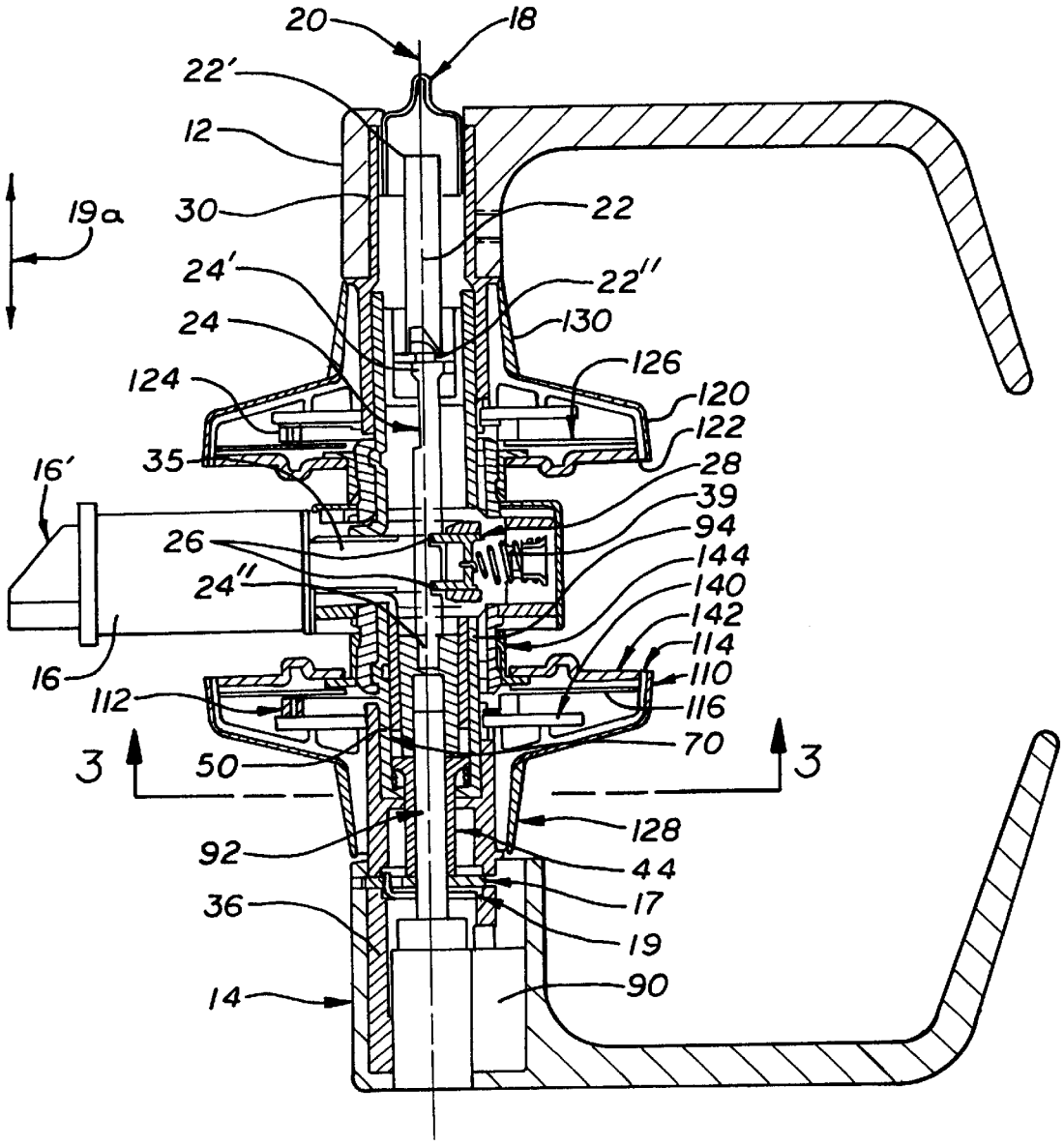
FIG. 1 is a cross-section view of the lock arrangement in the locked condition.

Referring now to the drawings and in particular FIGS. 1 through 13 and in particular FIGS. 1 through 6, there is illustrated a preferred embodiment of the invention described in the above mentioned co-pending applications incorporating a push turn button on the inside. As shown in FIGS. 1 through 6 there is a lock arrangement generally designed 10 having an inner handle which in preferred embodiments of the present invention is an inner lever 12, an outer handle which in preferred embodiments of the present invention is an outer lever 14 and retractable latch arrangement 16 having a latch portion 16'. The latch arrangement 16 may be of conventional design utilized in locks and the latch portion 16' is biased into the latching position thereof by latch springs (not shown). The retractor 35 is moved against the retractor springs 34 by the various spindles of the present invention, as described below, to cause retraction of the latch portion 16' which allows the door to be opened. A push/turn button 18 is shown in the inwardly directed position which is the locked position and in which the push/turn button 18 is moved towards the outer lever 14. Outer lever retainer 17 and spring 19 are provided as shown on FIGS. 1 and 2 for purposes known in the art.

Figure 2:
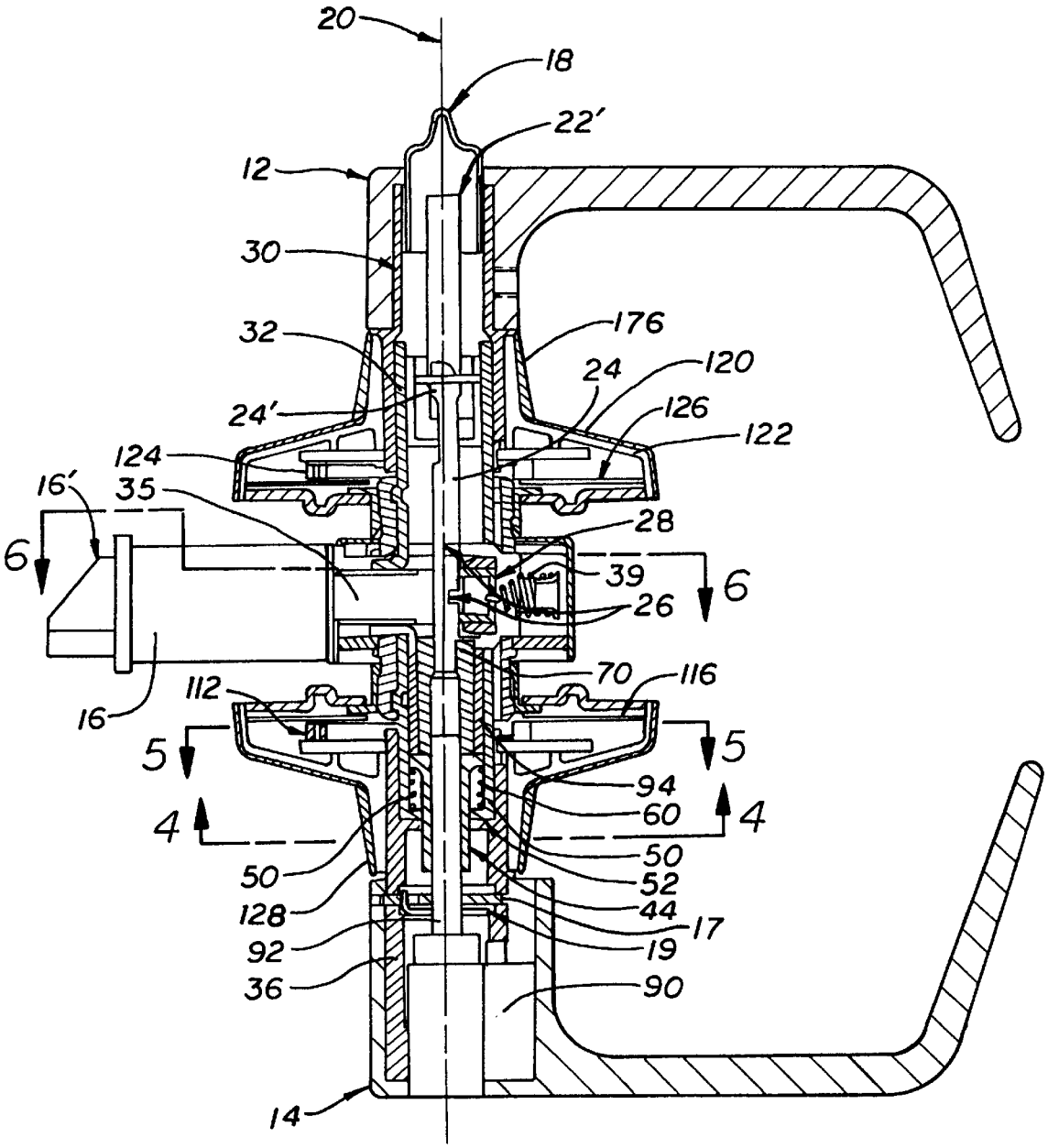
FIG. 2 is a cross-section view of the lock arrangement in the unlocked condition.

A mounting means 22 is connected to the push/turn button 18 at its first end 22' and has a second end 22" connected to a dogging bar 24 at the first end 24' thereof. The dogging bar 24 at the first end 24' therefore. The dogging bar 24 has a second end 24". In preferred embodiments of the present invention of the dogging bar 24 is substantially aligned with and along the axis 20. Detents are provided in the dogging bar at 26 for retention of the push/turn button in the locked position by engagement with the catch 28. A spring 39 (FIG. 6) biases the catch 28 towards the dogging bar 24 and is moved into compression to move the catch 28 out of engagement with the detents 26 of the dogging bar 24 when the retractor 35 is moved to unlock and open the door. A spring, as described below in connection with FIG. 9, biases the push/turn button 18 into the unlocked position as illustrated in FIG. 2. The push/turn button 18, as noted above, also rotates about the axis 20 during the reciprocating movement thereof in the directions indicated by the arrow 20.

In the embodiment 10 the dogging bar 24 moves reciprocatingly and rotationally independently of the movement of the inner lever 12. Thus, to lock the door, the push/turn button 18 is moved inwardly towards the outer lever 14 and then rotated to engage the detents 26 with the catch 28, as shown in FIG. 1. To unlock the door from the inside, the push/turn button 18 is rotated to free the detents 26 from the catch 28 and the dogging bar 24 and push/turn button 18 are moved away from the direction of the outer lever 14 to the unlocked position shown on FIG. 2. For the latch in the latched position as shown in FIGS. 1 and 2 the door is in the locked condition. That is, the door cannot be opened unless the latch is retracted. For the latch retracted, the door is in the unlocked condition and may be opened. The various embodiments described herein allow selective operation of the latch to retract the latch and allow the door to be opened.

In those embodiments of the present invention in which the inner push button is just a "push" button and not a push/turn button as in the embodiment 10, the push button moves reciprocatingly along the first axis 20 until the detents 26 are aligned with the catch 28. The spring 29 biases the catch 28 to engagement with the detents 26. To provide unlocking of such an embodiment the "push" button is operatively connected to the inner lever 12 for rotation therewith. Rotating the inner lever 12 rotates the "push" button and dogging bar 24 to force the detents 26 from the catch 28. The dogging bar 24 and "push" button then move in a direction away from the outer handle to the position shown in FIG. 2. To lock the door from the unlocked position shown in FIG. 2, the "push" button is moved toward the outer lever 18 until the detents 26 are aligned with the walls of the catch 28. The inner lever is then rotated which rotates the "push" button and dogging bar, the bias of spring 39 forces the walls of catch 28 into engagement with the detents 26 thus locking the door.

The inner lever 12 is connected to an inner lever spindle 30 for rotation with the inner lever 12 and the inner lever spindle engages an inner drive spindle 32 for rotational movement thereof about the axis 20. The inner drive spindle 32 is operatively connected to the latch arrangement 16 for engagement with the retractor 35 for retraction of the latch portion 16' against the bias of the retractor springs 34 upon rotation of the inner lever 12 about the axis 20. As noted above, movement of the retractor 35 also moves the spring 39 to move the catch 28 away from engagement with the dogging bar 24 detents 26. This releases the dogging bar 24 from the catch 28.

The outer lever 14 is connected to an outer lever spindle 36 which rotates with the outer lever about the axis 20. The outer lever spindle 36 is generally tubular and is concentrically mounted on the first axis 20.

As shown more clearly on FIG. 2, the outer lever spindle 36 has an inner tab portion generally designated 40 which extends radially inwardly towards the axis 20. The inner surface 42 of the tab portion 40 has a first preselected geometrical configuration, for purposes as hereinafter disclosed. As shown, for example in FIGS. 3 and 4, in the embodiment 10 the first preselected geometrical configuration is a square.

A driver generally designed 44 is coaxially positioned on the center line 20 and has a first end 45, an outer surface generally designated 46 having a first section generally designed 48 which has the same first preselected geometrical configuration as the inner surface 42 of the tab 40 of the outer lever spindle 36. The driver 44, in the embodiment 10, is generally tubular and is illustrated in greater detail in FIG. 7.

Rotation of the outer lever 14 rotates the outer lever spindle which, through engagement of the inner surface 42 of tab portion 40 with the first section 48 of the outer surface 46 of the driver 44 rotates the driver 44 about the axis 20.

Figure 9:
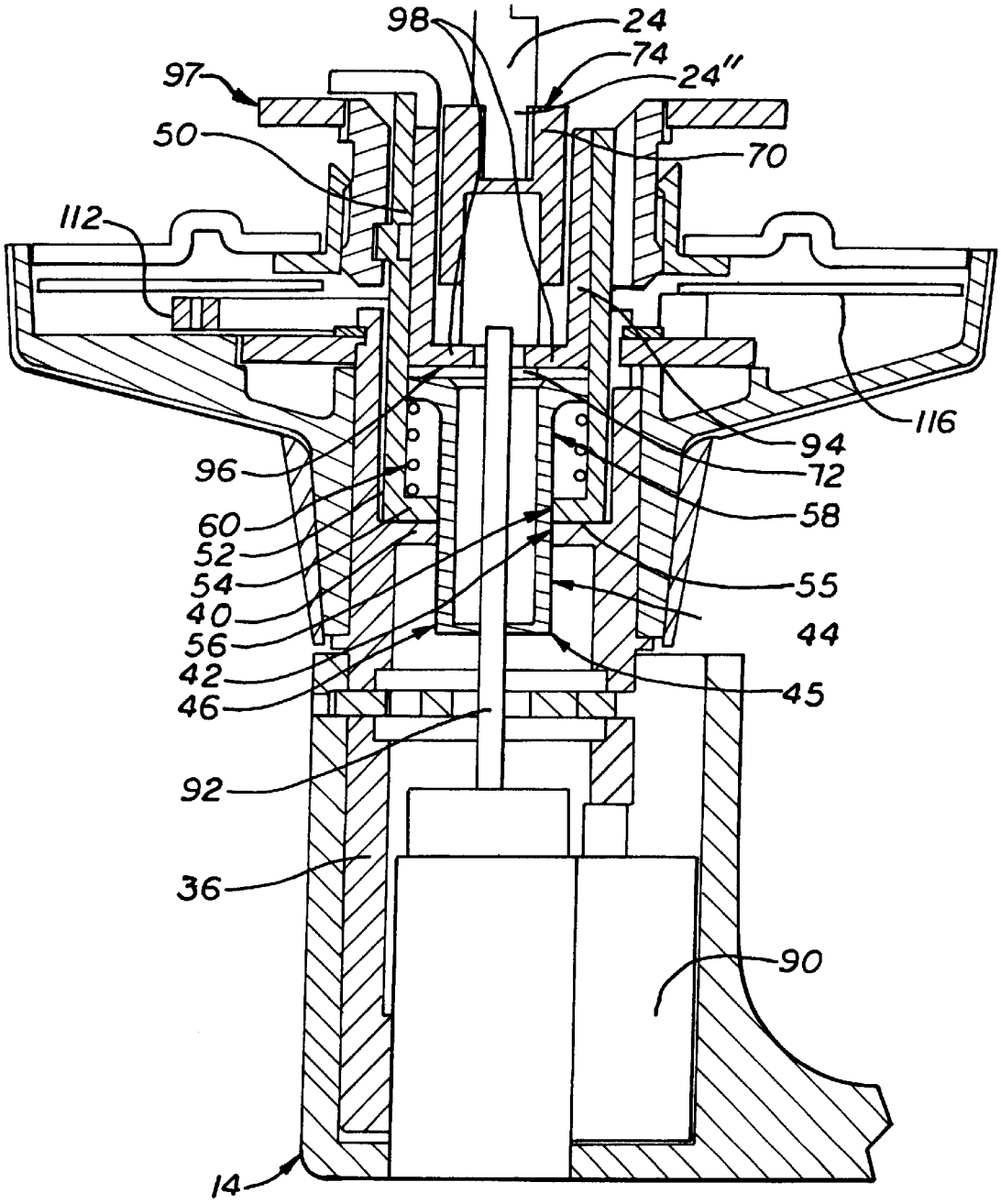
FIGS. 9 and 10 are enlarged cross-sectional views showing the key spindle, push cap or push cup and tail piece as mounted in the lock.
Figure 10:
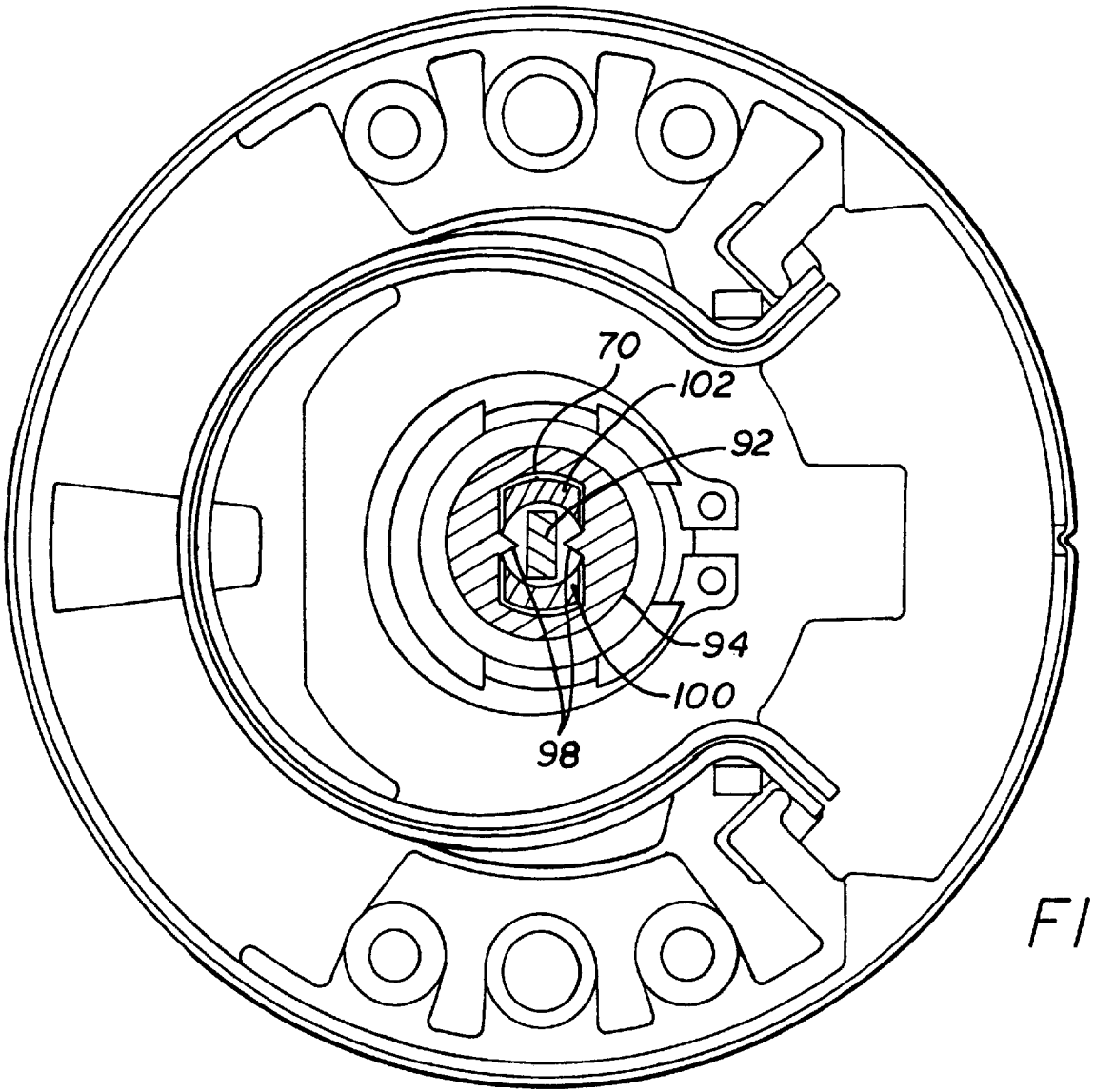

As illustrated in FIG. 9, which shows embodiment 10 in the unlocked position, there is also provided a generally tubular outer drive spindle generally designated 50 which has a first end 52 having a radially inwardly-directed tab portion 54 having an inner surface 56. The inner surface 56 of the tab portion 54 of the outer drive spindle 50 has the above-stated first preselected geometrical configuration. The tab portion 54 is adjacent the tab portion 40 of the outer lever spindle 36 and the spacing therebetween is preferable small, as indicated at 55 being just sufficient to allow independent rotation of the outer lever spindle 36 and outer drive spindle 50.

The driver 44 has a second section 58 of the outer surface 46 and the second section 58 has a second preselected geometrical configuration. The radial extent from the axis 20 of the second section 58 is less than the radial extent of the first section 48 of the driver 44. The difference in radial extent between the first section 48 and the second section 58 is such that for the condition of the second section 58 aligned with the tab 54 of the outer lever driver 50 the tab 54 is free of engagement with the second portion 58. As a result thereof, rotation of the driver 44 about the axis 20 as caused by rotation of the outer lever 14 and outer lever spindle 36 and outer drive spindle 50 is not rotated. For the lock arrangement 10 in the locked position, the second section 58 of driver 44 is aligned with tab 54 outer lever driver 50 and first section 48 of driver 44 is aligned with tab 40 of outer lever spindle 36. In the unlocked position of the lock arrangement 10, the first section 48 of driver 44 is aligned with both tab portion 54 of outer driver spindle 50 and tab portion 40 of outer lever spindle 36. In the unlocked position of lock arrangement 10, rotation of the outer lever 14 rotates the outer lever spindle 36 which rotates the driver 44 which, in turn, rotates the outer driver spindle 50.

A spring 60 is positioned between a flange 62 at the second end 64 of the driver 44 and the spring 60 also engages the tab 54 of the outer drive spindle 50 for resiliently biasing the driver 44 into the unlocked position as depicted in FIG. 9.

Figure 11:
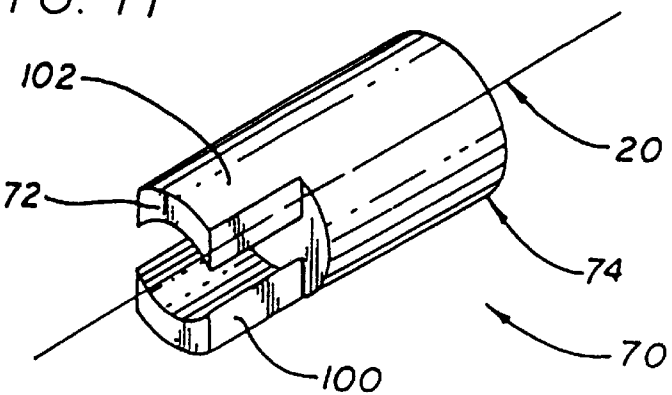
FIG. 11 is a perspective view of a tubular push cap or push cup useful in the practice of the present invention.

A push cap or push cup 70 which is illustrated in greater detail on FIG. 11 is coaxially mounted on the axis 20 and interior of the outer drive spindle 50. The push cap has a first end generally designated 72 which engages the flange 62 at the second end 64 of the driver 44. The push cap 70 has a second end 74 against which the dogging bar 24 abuts. Movement of the dogging bar 24 towards the outer lever 14 in the direction indicated by the arrow 76 moves the push cap 70 and driver 44 against the bias of the spring 60.

Movement of the push button 18 (FIGS. 2 and 3) in the direction indicated by the arrow 76 for the condition of the detents 26 free of locking engagement with the catch 28 moves the dogging bar 24 in the direction of the arrow 76. The push cap 70, as moved by the dogging bar 24, pushes the driver 44 towards the outer handle 14 until the second section 58 of the outer surface 46 of the driver 44 is radially aligned with the inner surface 56 of the tab 54 of the outer drive spindle 50. Such movement and position of the driver 44 corresponds to the locked position and the detents 26 engage the walls of the catch 28. As noted above in the locked position the second section 58 does not engage the inner surface 56 of the tab portion 54 of the outer drive spindle 50. For such condition rotation of the outer lever 14 causes rotation of both the outer lever spindle 36 and the driver 44 about the axis 20 but without rotation of the outer drive spindle 50. As a result, for the lock arrangement of embodiment 10 in the locked condition as provided by operation of the push button 18, rotation of the outer handle 14 does not retract the latch 16'.

The outer drive spindle 50 has an ear 80 which engages the retractor 35 of the latch arrangement 16 to move the retractor 35 against the retractor springs 34 to retract the latch 16'. In the locked position the outer drive spindle 50 is not rotated with rotation of the outer lever 14 and there is no retraction of the latch 16'.

In some of the preferred embodiments of the invention key cylinder 90 one of the types known in the art such as a conventional or a removable cylinder is positioned within the outer lever 14 and is connected to a tail piece generally designated 92 which, in the embodiment 10, is aligned along the axis 20.

A generally tubular key spindle 94 is positioned intermediate the outer driver spindle 50 and the push cap 70. The key spindle 94 has a first end 96 provided with drive tabs 98. As shown most clearly in FIGS. 5 and 9 rotation of the tail piece 92 causes it to engage the inwardly-directed tabs 98 to rotate the key spindle 94. An inner end 95 of the key spindle 94 has a flange 97 which engages the retractor 35 of the latch arrangement 16' to cause a retraction of the latch 16 against the resiliency of the retractor springs 34. In such an embodiment the driver 44 is tubular to allow the tail piece 92 to extend therethrough and the push cap 70 has engaging portions 100 and 102 which extend through the key spindle 94 for engagement with the push cap 44.

Figure 7:
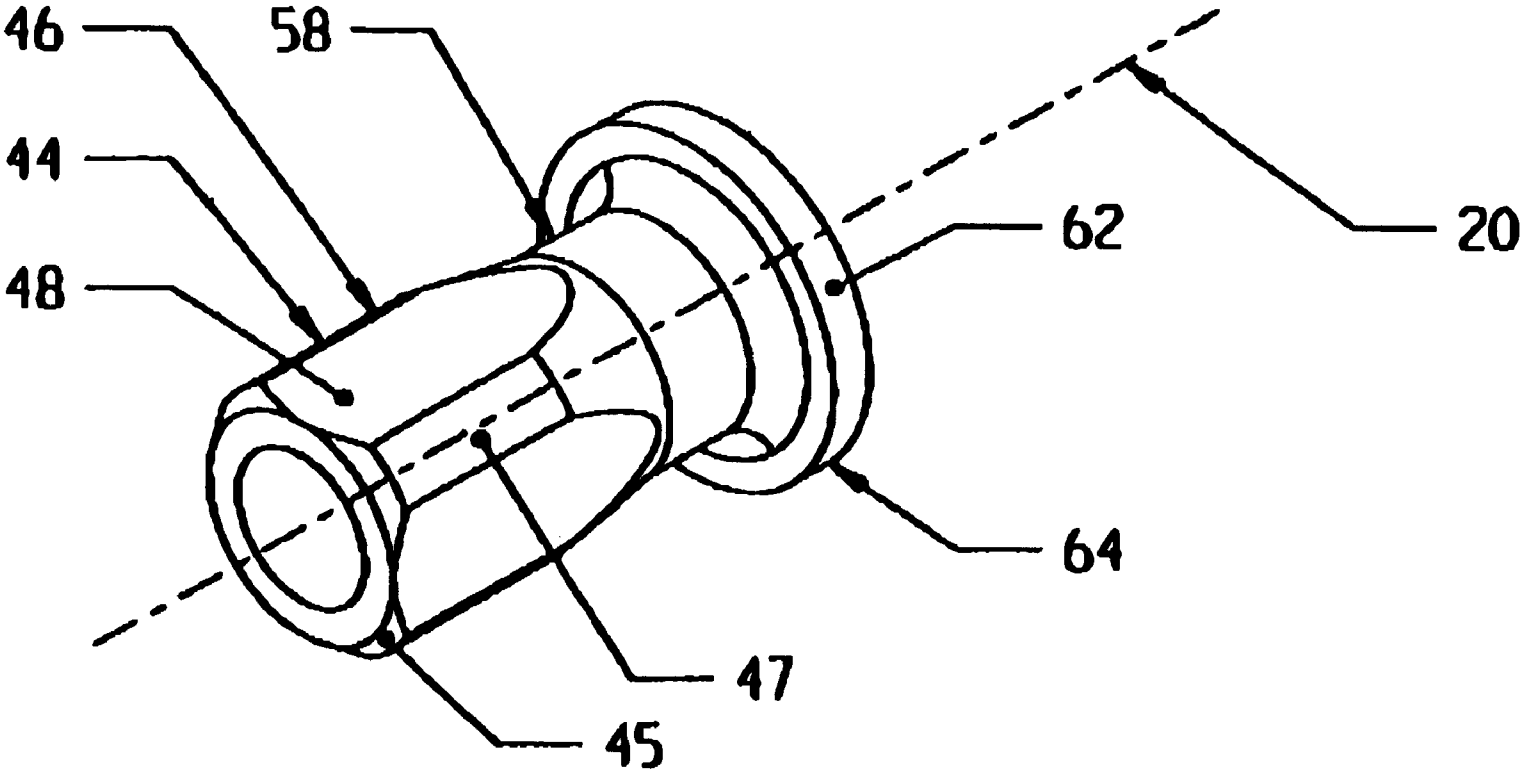
FIG. 7 is a perspective view of a driver shown in the embodiment of FIG. 1.

As illustrated in FIG. 7 the first section 48 of the outer surface 46 of driver 44 has the first preselected geometrical configuration and cross-section which, in embodiment 10, is generally square having slight chamfers as indicated at 47. This cross-sectional configuration, as noted above, corresponds to the cross-sectional configuration of the inner surface 42 of the tab 40 of outer lever spindle 36 and the inner surface 56 of the tab 54 of the outer driver spindle 50. The second section 58 of the outer surface 46 of the driver 44 has the second preselected geometrical configuration and cross-section which in embodiment 10, is round. However, other geometrical configurations for the first section 48 and second section 58 of driver 44 may be selected. It is necessary, however, that in the locked position the second section 58 be free of rotational drive engagement with the surface 56 of tab 54 of outer drive spindle 50.

Figures 8A, 8B, 8C:
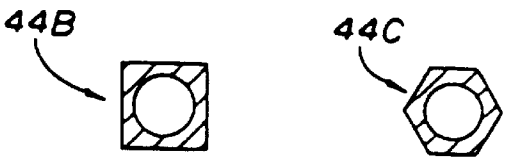
FIGS. 8A through 8G illustrate various cross-sectional configurations of a portion of the driver.
Figures 8D, 8E, 8F:
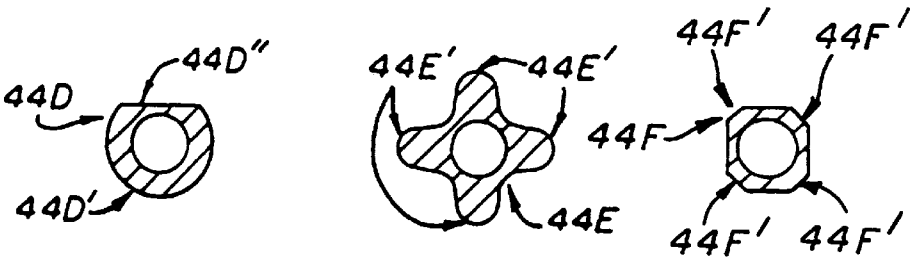

FIG. 8A illustrates various other geometrical configurations for the cross-section of the first section 48 of the outer surface 46 of the driver 44. In each embodiment utilizing such cross-sections the inner surface 42 of the tab 40 on the outer lever spindle 36 and the inner surface 56 of the tab 54 on the outer drive spindle 50 have surfaces for engagement with the first section 48 of the driver 44. In preferred embodiments of the present invention, the interior surfaces 42 and 56 of tabs 40 and 54, respectively, have the same geometrical configuration as the geometrical configuration of the first section 48 of the driver 44. However, the principles of the present invention may be accomplished by having a wall section of the inner surfaces 42 and 56 of the tabs 40 and 54, respectively, having a driving engagement with the first section 48 of driver 44. Thus, in FIG. 8A the geometrical cross-sectional configuration is generally triangular for a driver generally designated 44A. In FIG. 8B the cross-sectional configuration of the driver 44B is generally rectangular. For the driver 44C of FIG. 8C the cross-sectional configuration is generally hexagonal. For the driver 44D of FIG. 8D the cross-sectional configuration has a round portion generally designated 44D' and a planar portion generally designated 44D". In FIG. 8E a driver 44E has a generally sinusoidal cross-sectional configuration having the lobes 44E', but no planar section. FIG. 8F is similar to FIG. 8 B except that the corners are rounded as shown at 44F'. In each of the drivers 44A through 44F it will be appreciated that the second portion 58 through 44E it will be appreciated that the second portion 58 (not shown in FIGS. 8A through 8E) of the outer surface 46 has a geometrical configuration such that the second portion 58 does not engage the inner surface 56 of the tab 54 on the outer driver spindle 50 for the condition of the driver in the locked condition. Thus, the second section 58 of outer surface 46 or driver 44 may be the same geometrical configuration as the first section 48 of outer surface 46 of a different geometrical configuration as long as the radial extent thereof prevents driving engagement with the inner surface 56 of tab 54 of outer drive spindle 50 in the locked condition.

Figure 7A:
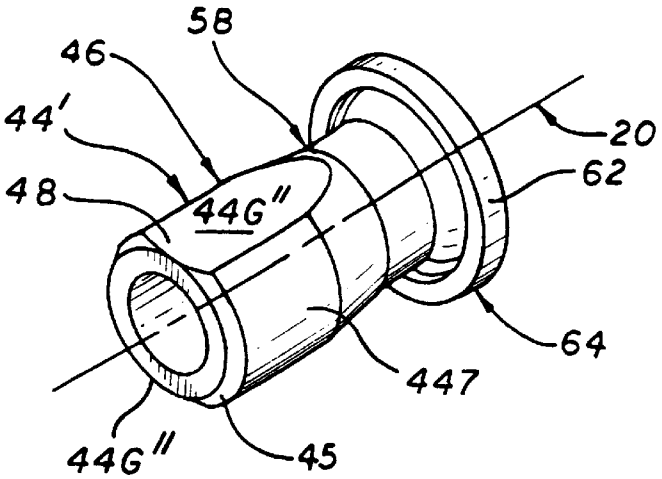
FIG. 7A is a perspective view of a modified form of a driver shown in the embodiments of FIGS. 14, 19 and 20.
Figure 8G:
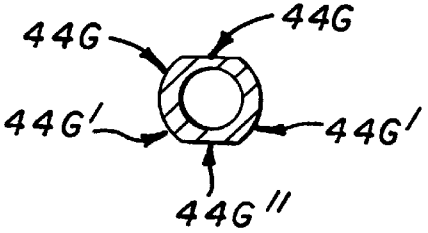

FIG. 8G is a preferred form of the first portion of the outer surface of the driver. It has been found that the configuration of FIG. 8G, which for convenience of description herein, is called a double "D" shape and prevents the outer handle from becoming located in a non-horizontal position which may occur under certain circumstances with other configurations of the first portion of the outer surface of the driver. The configuration of FIG. 8G may be utilized in the embodiments of the invention described in the above mentioned co-pending applications as well as the embodiments described herein. FIG. 7A illustrates a perspective view of a driver 44' similar to the driver 44 but having the first section or portion 48 of the outer surface 46 has the first preselected geometrical configuration and cross section which is the double "D" configuration of FIG. 8G and has the pair of opposed planar sections 44G" and the pair of opposed round sections 44G'. The second portion or section 58 of the outer surface 46 of driver 44' is round. The double "D" configuration may be advantageously utilized, for example in the embodiment 10 as well as the embodiments shown in FIGS. 12 and 13 described below.

Referring to FIGS. 1 and 2, the embodiment 10 also has an outer rose cover 110 which contains an outer lever return spring means 112 within a rose insert 114 inside of the rose cover 110. The outer lever return spring 112 returns the outer lever 14 after rotation to its preferred position which, generally, is horizontal. The double "D" configuration prevents the outer handle from returning to a non-horizontal position under the forces of the spring means 112. An outer lever return spring retainer plate generally designed 116 is positioned within the outer rose insert 114 to retain the outer lever return spring 112 in position.

There is also an inner rose cover 120 surrounding an inner rose insert 122 and positioned within the inner rose insert 122 is an inner lever return spring means 124 retained in position by an inner lever return spring retainer plate 126. Similarly, an outer collar generally designated 128 and an inner collar generally designated 130 are provided for proper retention of the rose covers in position.

The lock arrangement of embodiment 10 as shown in FIG. 1, also includes an outer lever stop plate 140, outer lever mounting plate 142, and outer lever mounting plate nut 144 for purposes well known in the art. Similar structure for the inner lever 12 are also provided as illustrated in FIG. 1. Similarly, snap ring 141 is provided to retain axial alignment of the components as required.

Figures 12, 13:
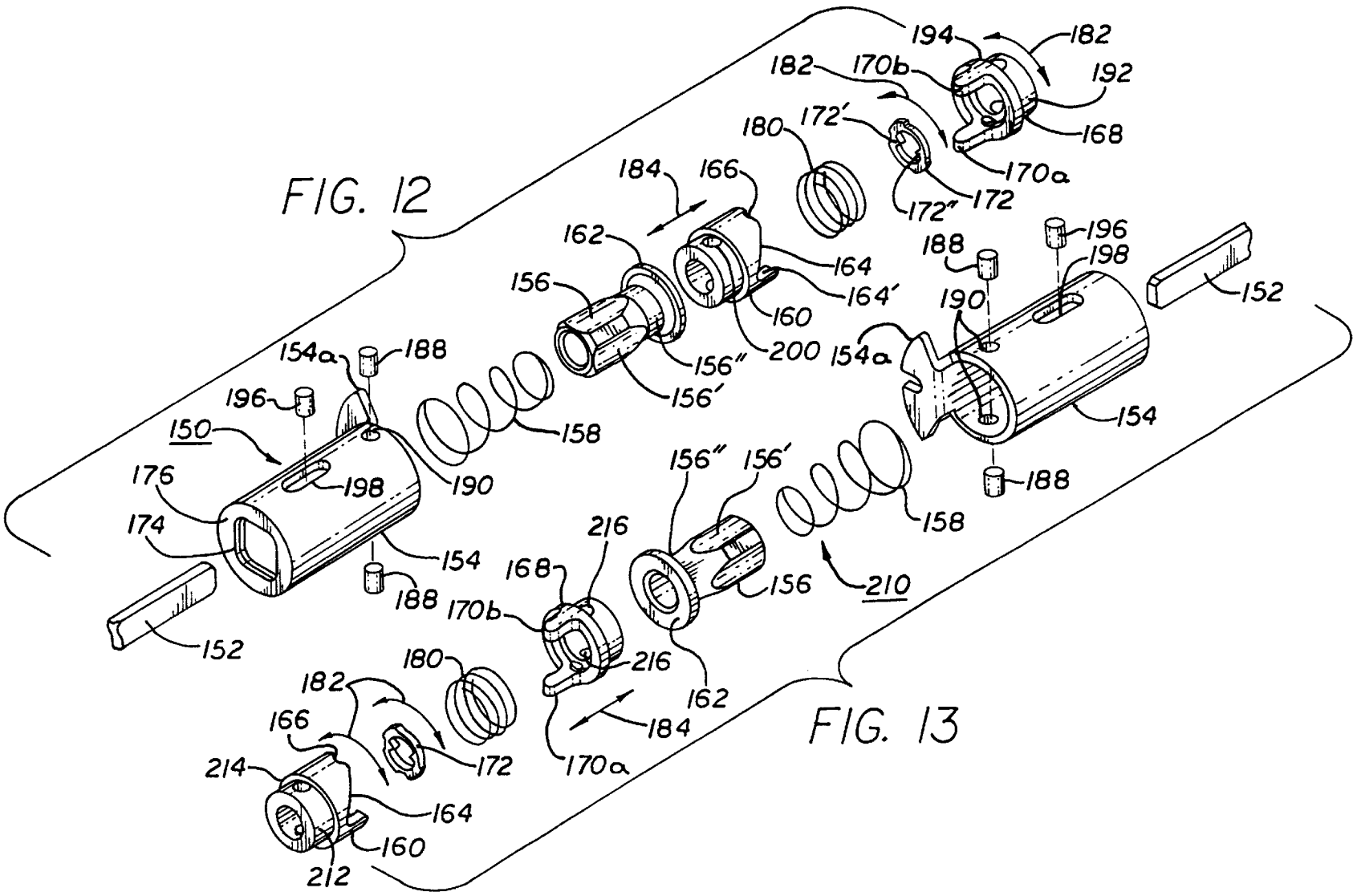
FIG. 12 is an exploded view of another embodiment of the present invention.
FIG. 13 is an exploded view of another embodiment of the present invention.

Referring now to FIG. 12, there is shown an embodiment generally designated 150 of the invention described in the above identified co-pending applications in which there is not provided any button on the inside of the inner lever. As noted above, in such embodiments the push cap or push cup 70 is omitted as well as the push button and dogging bar. The rotation of the inner lever always causes operation of the latch so that the door may be opened. Locking and unlocking is accomplished from the outside. As shown in FIG. 12, a tail piece 152 which may be similar to tail piece 92 of the embodiment 10 extends axially through a generally tubular outer drive spindle 154 which may be similar to outer drive spindle 50. A driver 156 similar to driver 44 and spring 158 similar to spring 60 are positioned in outer drive spindle 154 for rotational and reciprocating motion. A cam 160 abuts against the flange 162 of driver 156 and has a cam face 164 and detents 166.

Resilient means 180 is positioned between cam 160 and a cam follower 168 mounted in the lock mechanism of embodiment 150. The cam follower 168 rotates in the directions indicated by the arrow 182. The cam follower 168 has prongs 170*a* and 170*b* which engage the detent 166 in cam 160 for the lock in the locked condition. The cam 160 moves in reciprocating directions as indicated by the arrow 184. The prongs 170*a* and 170*b* of cam follower 168 engage the cam face 164 during the transition of the embodiment 150 from the locked condition to the condition allowing the door to be opened. The resilient means 180 biases the cam 160 away from the cam follower 168. A plate 172 is intermediate the cam 160 and cam follower 168 and operatively engages the cam follower 168 to rotate the cam follower 168. The plate 172 has tabs 172' and 172" which engage the tail piece 152. When the tail piece 152 is rotated, for example clockwise to rotate the cam follower 168 through engagement with the plate 172, the prongs 170*a* and 170*b* move out of the detents 166 and along the cam face 164 as the spring 158 biases the driver 156 and cam 160 toward the cam follower 168. This axial movement of the driver provides the alignment of the first section 156' of driver 156 with the inner surface 174 of tab 176 of the outer driver spindle 154. In such an alignment, operation occurs as described above. That is, rotation of an outer lever rotates the outer lever spindle which rotates the driver 156 to rotate the outer drive spindle 154 and the ear 154a engages a retractor to retract a latch. The outer lever and outer lever spindle are omitted for clarity in FIG. 12. For the embodiment 150 in the unlocked position, that is, for example, when the prongs 170*a* and 170*b* are at the bottom 164' of cam face 164, rotation of the tail piece 152 in the opposite direction, that is, counterclockwise, forces the cam follower 168 to rotate and forces the prongs 170*a* and 170*b* of cam follower 168 up the cam face 164 to the detents 166. Such motion forces the driver 156 outward until the second section 156" of the outer surface of driver 156 is aligned with inner surface 174 of tab 176 of outer drive spindle 154. In such condition, the driver 156 does not rotate the outer lever drive 154 upon rotation of the outer lever spindle and the embodiment 150 is in the locked condition.

Pins 188 are press fit into apertures 190 in outer driver spindle 154 and engage the outer end surface 192 of cam follower 168 and bear against rim 194 to prevent axial movement of the cam follower in a direction away from the outer drive spindle 154. In the embodiment 150 the biasing force of the spring 158 forces the cam 160 into engagement with the prongs 170*a* and 170*b* of cam follower 168. The biasing force of the spring 150 biases the prongs 170*a* and 170*b* into detents 166 thereby providing the embodiment 150 in the locked condition as the normal condition. Rotation of tail piece 152 allows the opening of the door to which the embodiment 150 is coupled. Pin 196 is positioned in slot 198 in drive spindle 154 and press fit into aperture 200 in cam 160. Slot 198 allows cam 160 to move, relative to drive spindle 154, in the directions indicated by the arrow 184. Such motion allows positioning of the driver 156 between the locked and the unlocked positions.

FIG. 13 shows another embodiment of the invention described in the above identified co-pending applications generally designated 210. The embodiment 210 is generally similar to the embodiment 150 of FIG. 12 except that the cam is mounted for rotational movement and no reciprocating movement, and the cam follower is mounted for reciprocating movement but not rotational movement. As shown on FIG. 13, a tail piece 152 extends axially through outer drive spindle 154. A driver 156 and spring 158 are positioned in outer drive spindle 154 for reciprocating and rotational movement. However, in embodiment 210, the cam follower 168 abuts against the flange 162 of driver 156 and has prongs 170*a* and 170*b*. The cam follower 168 moves in directions indicated by the arrow 184. A cam 160 is mounted in the lock mechanism for rotational movement in the directions indicated by the arrow 182. The prongs 170*a* and 170*b* of cam follower 168 engage the cam face 164 and detents 166 of cam 160. Pins 188 are press fit in apertures 190 in outer drive spindle 154 and engage the outer end surface 212 of cam 160 and bear against rim 214 to prevent axial movement of the cam 160 in a direction away from the outer drive spindle 154. Spring 180 provides a biasing of the cam follower away from the cam 160 to provide the prongs 170 and 170*b* in the detents 166 of cam 160 so that the normal position of the embodiment 210 is the locked position. To unlock the embodiment 210, the tail piece 152 is rotated and engages the plate 172 which operatively engages the cam 160 to rotate the cam 160 in the directions indicated by the arrow 182. The pin 196 is positioned in slot 198 of outer drive spindle and is press fit into one of the apertures 216 of cam follower 168. The slot 198 allows the reciprocating movement of the cam follower 168 in the direction of the arrow 184. Such reciprocating motion allows positioning of the first section 156 in drive engagement with outer drive spindle 154 as above described. Similarly, with the prongs 170*a* and 170*b* of cam follower 168 in detents 166 of cam 160, the locked position, the second section 156" is positioned relative to the outer drive spindle 154 so that rotation of the driver 156 does not rotate the outer drive spindle 154.

Thus, the embodiment 210 of FIG. 13 operates in a manner quite similar to the embodiment 150 of FIG. 12 except the positions of the cam 160 and cam follower 168 are reversed.

In other embodiments of the invention, the cam and cam follower structure, as shown in embodiment 150 and/or 210 above, may be provided on both the inside and outside of the lock and the tail piece in any of the cam and cam follower arrangements, on the inside and/or the outside of the lock, may be rotated by a key and key cylinder arrangement as above-described or by a turn button which rotates the tail piece. Further, in other embodiments of the present invention, only one cam and cam follower structure may be utilized, for example, on the inside, with a blank, non-removable plate on the outside. Other embodiments of the invention utilizing a cam and cam follower may incorporate various combinations of key and key cylinders, turn buttons, lever operation of latch retraction and similar structure as may be desired for particular applications.

In another embodiment of the invention, useful for example in bathrooms, a push button may be on the inside to allow locking of the lock. Such an arrangement may be similar to the embodiment 10 described above except that the key cylinder is omitted on the outside and a slotted button or a turn button is connected to the tail piece such as tail piece 92 of, for example, FIG. 1 to allow rotation of the tail piece 92 thereby retracting the latch to allow the door to be opened.

Figure 3:
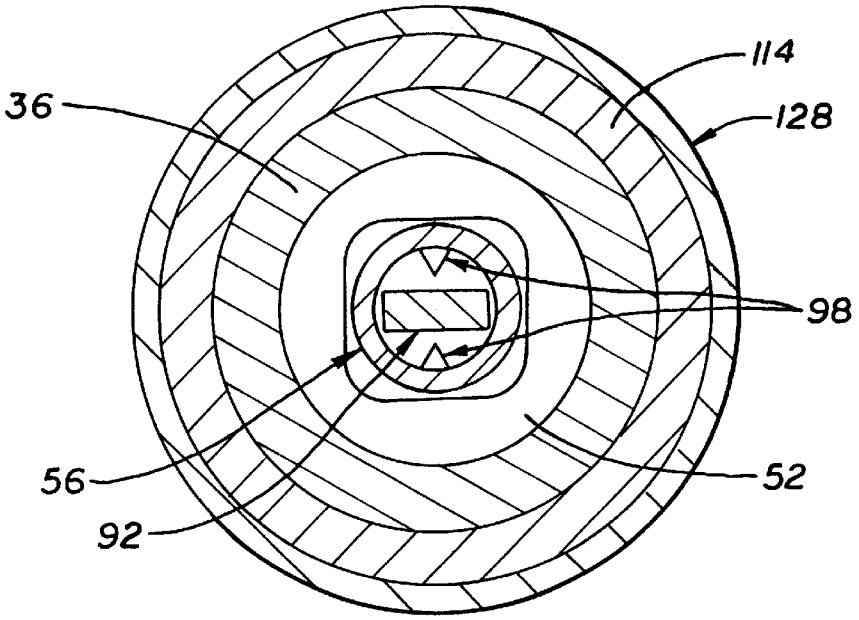
FIG. 3 is a sectional view along the line 3—3 of FIG. 1.
Figure 4:
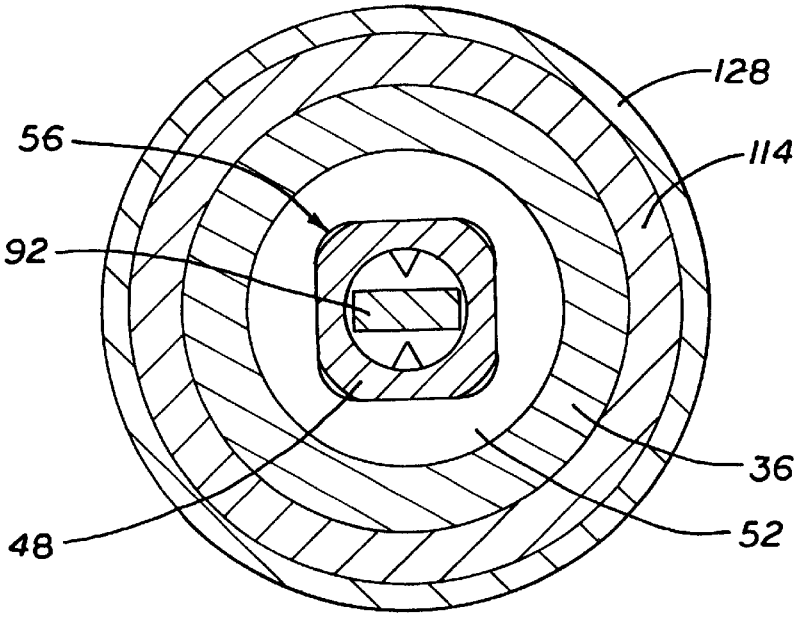
FIG. 4 is a sectional view along the line 3—3 of FIG. 2.
Figure 5:
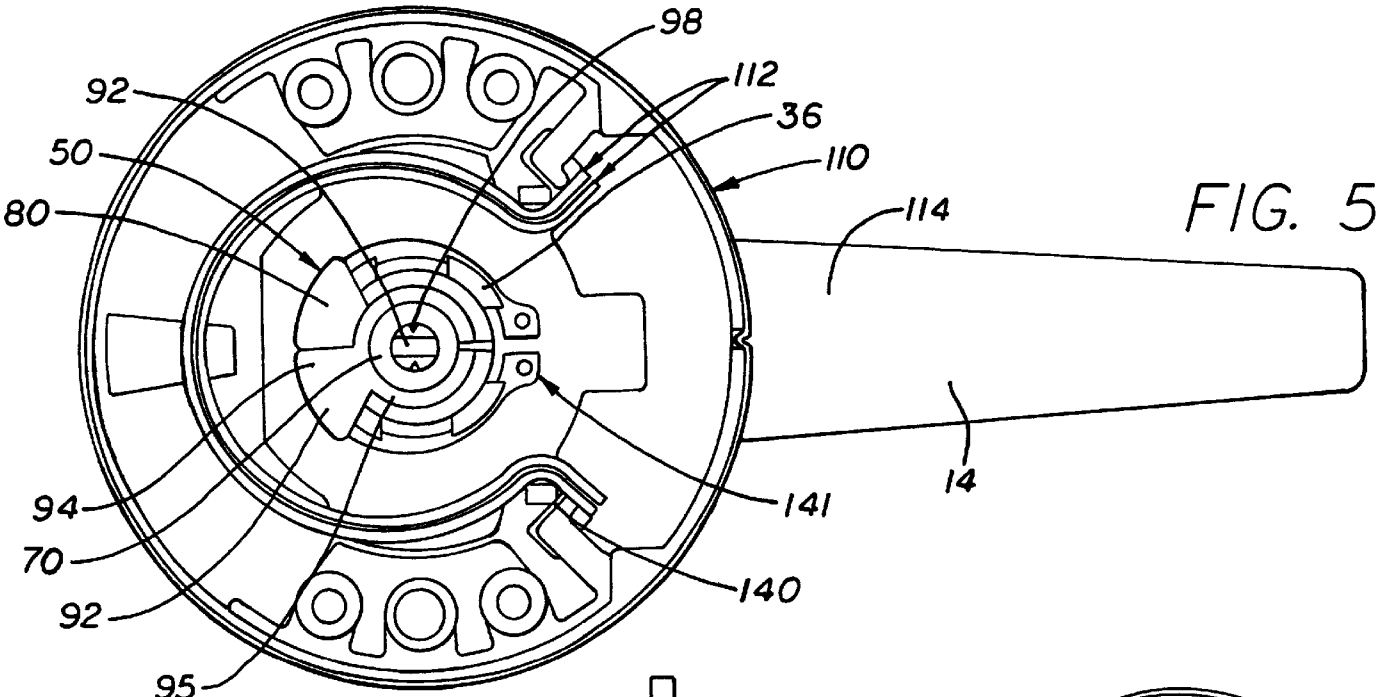
FIG. 5 is a sectional view along the line 3—3 of FIG. 2.
Figure 6:
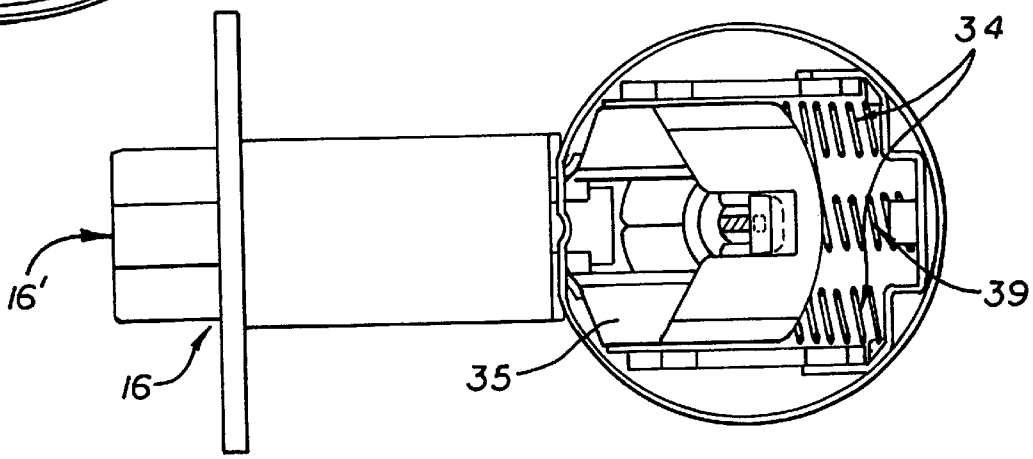
FIG. 6 is a sectional view along the line 3—3 of FIG. 2.
Figure 14:
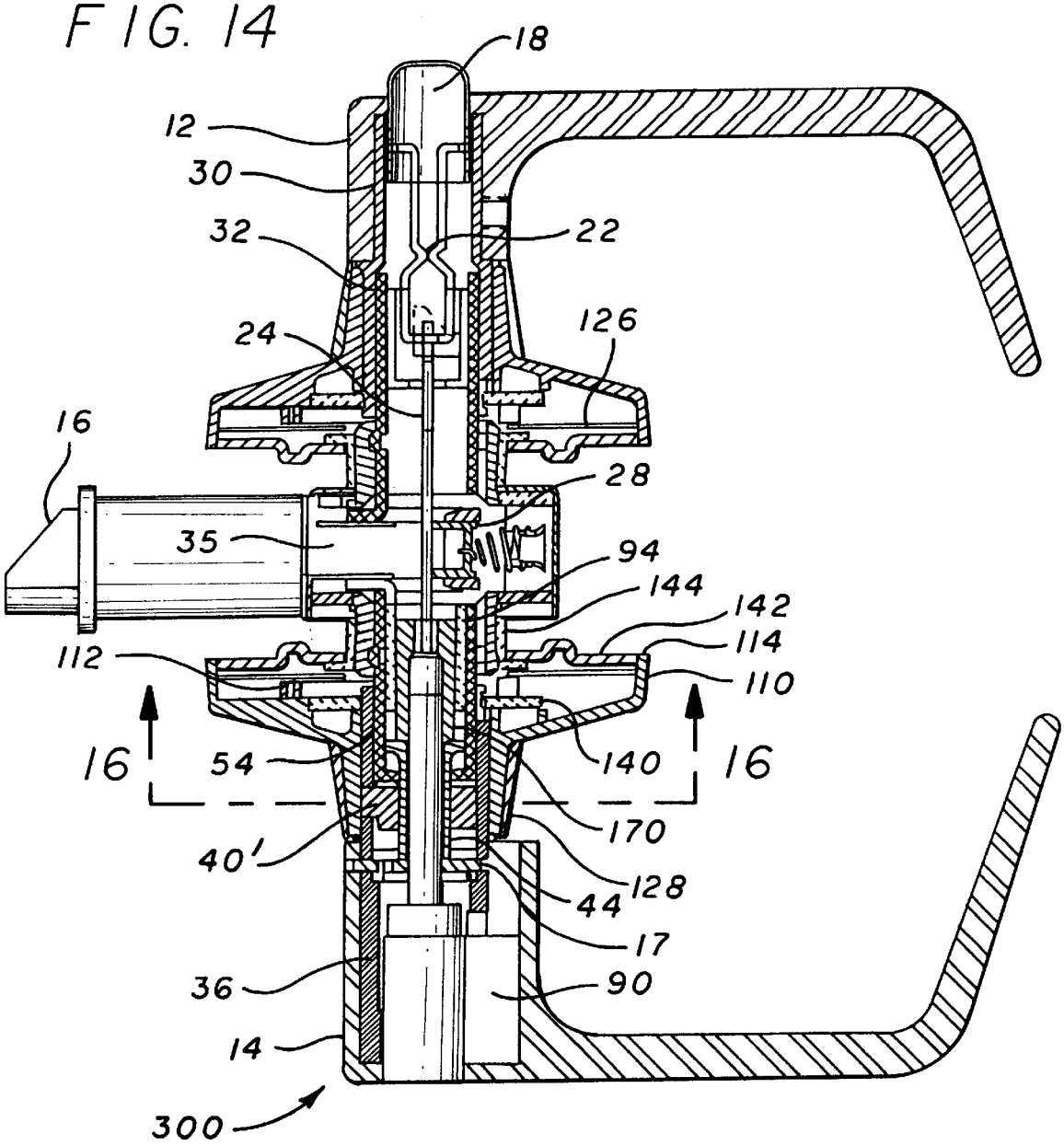
FIG. 14 is a sectional view, similar to FIG. 1 of a modified form of a lock arrangement with a clutch.
Figure 16:
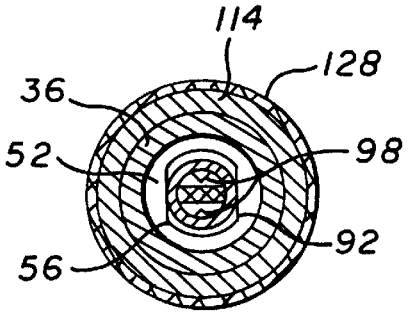
FIG. 16 is a sectional view along the line 16—≠of FIG. 14 similar to the sectional view of FIG. 3.
Figure 15:
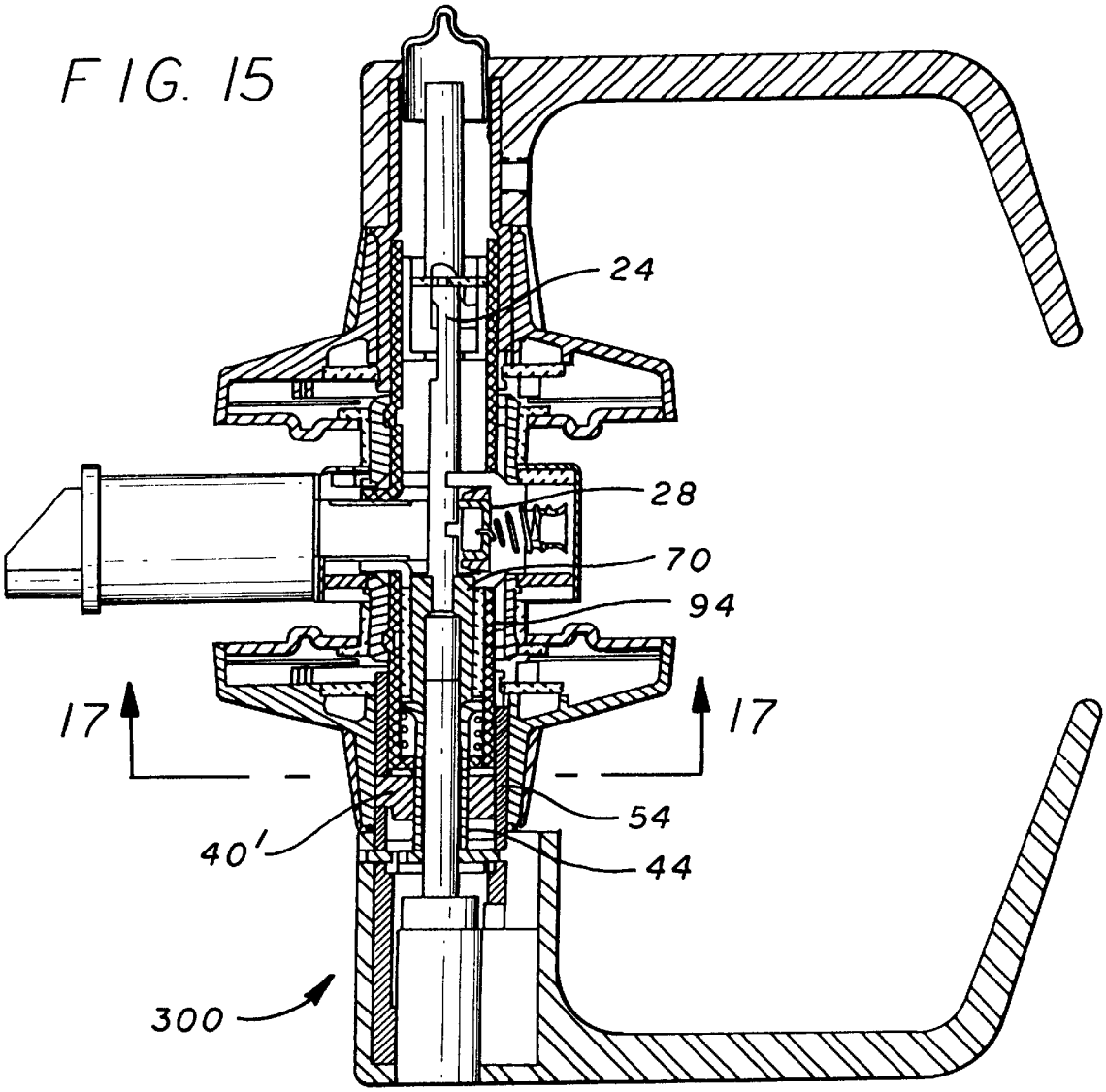
FIG. 15 is a sectional view, similar to FIG. 2 of the modified form of a lock arrangement with a clutch shown in FIG. 14.
Figure 17:
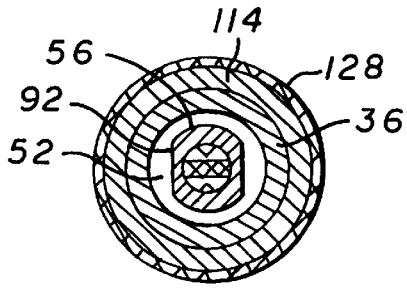
FIG. 17 is a sectional view along the line 17—17 of FIG. 15 similar to the sectional view of FIG. 4.
Figure 18:
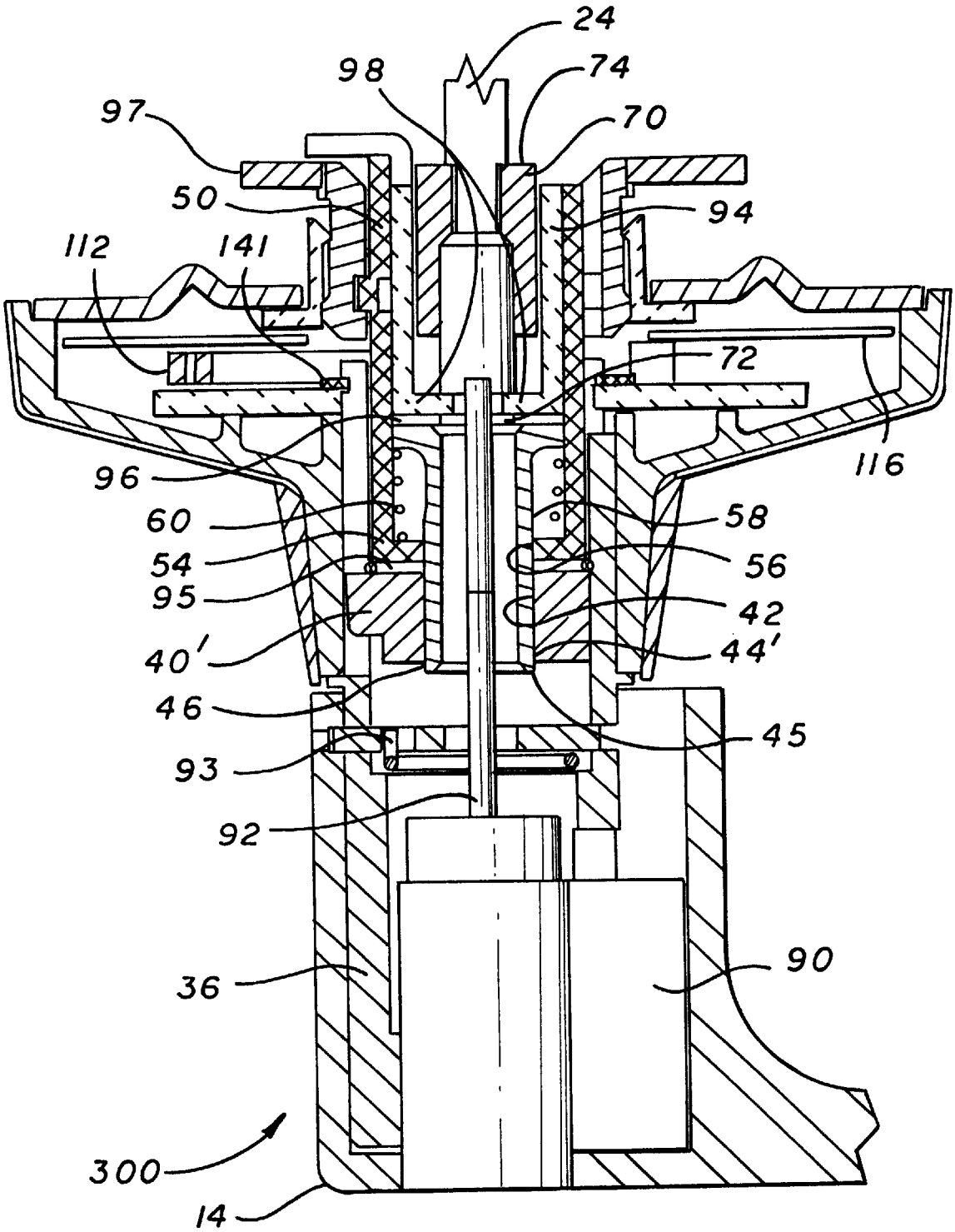
FIG. 18 is a sectional view of the embodiment of FIGS. 14 and 15 and is similar to FIG. 9 and showing the lock in the unlocked condition; and, FIG. 19 is an exploded view of a solenoid operated embodiment of the present invention.

Referring now to FIGS. 14, 15, 16, 17 and 18 there is shown an embodiment 300 generally similar to the embodiment 10 described above and similar reference characters in these Figures correspond to the similar parts of embodiment 10 and FIG. 14 corresponds to FIG. 1, FIG. 15 corresponds to FIG. 2, FIG. 16 corresponds to FIG. 3, FIG. 17 corresponds to FIG. 4 and FIG. 18 corresponds to FIG. 9. In FIGS. 14, 15, 16 and 17, some detailed parts have been omitted for clarity as they have in FIGS. 1 through 4. As shown most clearly in 18, the tab portion 40 (FIG. 9) of the outer lever spindle has been replaced by a separate structure: the driver insert 40' which is mounted on the outer drive spindle 36 and rotates therewith. The driver insert 40' rotates the driver 44 in the unlocked position of the lock which rotates the outer drive spindle 54 to cause the retraction of the latch 16 (FIG. 1). In the locked position of the lock, the tab 56 on the outer drive spindle is aligned with the second section or portion 58 of the outer surface 46 and thus does not rotate when the outer handle 14 is rotated. As shown most clearly on FIG. 18, it has been found advantageous to place a first spring 93 in the location shown and a second spring 95 in the location shown. The operation of the embodiment 300 is otherwise substantially similar to the operation of the embodiment 10. The driver 44' has the configuration of the driver illustrated in FIG. 7

Figure 19:
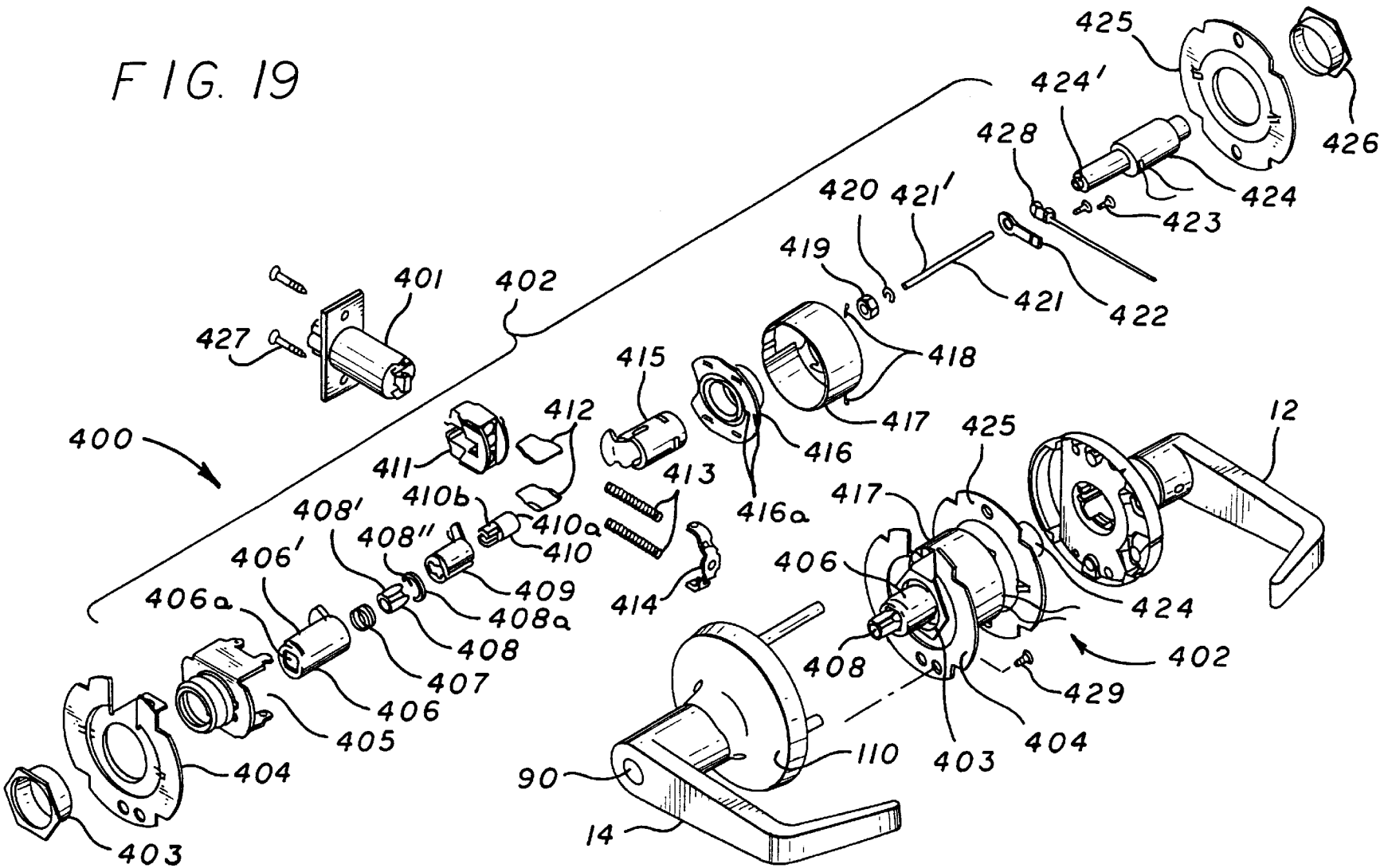

Referring now to FIG. 19, there is shown an embodiment 400 of a fail safe solenoid operated lock according to the principles of the invention herein. The use of a solenoid provides advantages over the use of a turn button or push/turn button as described above. One important advantage is that the lock may be operated from a location remote from the door containing the lock. The use of the clutch arrangement of the invention described herein when combined with the flexible operational characteristics of a solenoid operated lock offers to the user a much greater variation for applications of a locked door which may be selectively locked and unlocked from a remote location. The embodiment 400 includes a latch assembly 401 similar to the latch assembly described above and includes mounting screws 427, retractor 411, retractor insert 412, retractor spring 413 and retractor spring retainer 414, the embodiment 400 also includes and a chassis assembly 402. The chassis assembly 402 is shown in FIG. 19 both in an exploded view and in an assembled view. The inner flanged nut 426 threadingly engages the inner hub and plate 416 and an outer flanged nut 403 threadingly engages an outer hub and housing. An outer mounting plate 404 and an inner mounting plate 425 are provided for the chassis assembly 402 as shown. A solenoid 424 is provided and has a push rod 421 mounted therein with a retaining clip 420 at the remote end 421'. A nut 419 threadingly engages the inner end 424' of solenoid 424 to secure the solenoid mounting plate 422. Screws 423 engage the holes 416*a* in inner hub and plate 416 for mounting the solenoid 424 thereon. The push rod 421 moves reciprocatingly as controlled by the solenoid 424 to effectuate the locking/unlocking of the embodiment 400. A driver 408, which may be in the configuration shown in FIG. 7A, is co-axially mounted with the push rod 421 and is biased toward the solenoid 424 by spring 407 which abuts against outer drive spindle 406. When the first surface 408' of driver 408 is aligned with aperture 406' in outer drive spindle 406 the lock is in the unlocked condition and rotation of the outer handle 14 will cause the flange 406' to engage the latch assembly 401 to retract the latch. A push actuator which acts in a manner similar to the push cup or push cap 70 described above and has an inner end 410*a* in engagement with clip 420 and an outer end 410*b* in engagement with the inner end 408*a* of the driver 408. A key spindle 409 may be provided for retraction of the latch when a key is utilized in the key cylinder 90 as described above. An inner drive spindle 415 is also provided for retracting the latch when the inner handle 12 is rotated. A cable tie 428 may also be provided and cotter pins 418 may be utilized to hold the embodiment in the assembled condition as shown. An outer lever spindle (not shown in FIG. 19) is mounted on the outer lever handle 14 for rotation therewith in both the locked and unlocked condition of the lock and may be similar to the outer lever spindle described above. Such outer lever spindle has a tab portion which has the same geometrical configuration as the first section or portion 408' of the outer surface of the driver 408.

In the fail safe embodiment 400, the solenoid 424 the push rod 421 is normally retracted so that the first surface portion 408' of driver is 408 is in engagement with the outer drive spindle 406 so that rotation of the outer handle 14 which rotates the outer lever spindle (not shown in FIG. 19) and retracts the latch. When the solenoid 424 is energized the push rod 421 is extended toward the outer handle 14 which moves the driver 408 in axial directions so that the second section or portion 408" of the outer surface of driver 408 is aligned with the aperture 406*a* of outer drive spindle 406 to put the lock into the locked condition.

In order to provide the fail secure embodiment of the present invention, the same structure as shown on FIG. 19 is utilized except that the solenoid 424 is replaced by a solenoid which in the normal or unenergised condition has the push rod 421 extending therefrom. As such, the lock is normally in the locked condition and when the solenoid 424 is energized the push rod 421 is retracted and the lock placed into the unlocked condition.

This concludes the description of the preferred embodiments of the present invention. Those skilled in the art may find many variations and adaptations thereof and the appended claims are intended to cover all such variations and adaptations falling within the true scope and spirit of this invention.

What is claimed is:

1. In a lock arrangement having a first axis and having a latch arrangement, including a latch, the improvement comprising:

an outer lever rotatable about the first axis;

an inner lever rotatable about the first axis;

a generally tubular outer drive spindle concentrically mounted on the first axis in regions adjacent said outer lever and having a first end and a second end and having a tab portion at said first end, and said tab portion extending radially inwardly, and said second end having a latch arrangement engaging flange portion, said tab portion having an interior driver-engaging surface;

a generally tubular outer lever spindle connected to the outer lever for rotation therewith about the first axis and said outer lever spindle having a tab portion extending radially inwardly toward the axis and said tab portion having a driver-engaging surface;

a generally tubular driver concentrically mounted on the first axis for rotational movement about the first axis and reciprocating movement along the first axis and having an internal surface, an external surface, a first end, and a second end, and said external surface and said internal surface extending from said first end to said second end, said driver having a locked position for the lock in a locked condition and an unlocked condition for the lock in an unlocked condition, and having:

said external surface having:

a first section having a first pre-selected geometrical configuration in regions adjacent said first end and extending toward said second end of said driver, and operatively engaging said driver-engaging surface of said tab portion of said outer lever spindle in said locked and unlocked positions, and operatively engaging said driver-engaging surface of said tab portion of said first end of said outer driver spindle in said unlocked position;

a second section intermediate said first section and said second end and having a second geometrical configuration and said second section aligned with said driver-engaging surface of said tab portion of said outer drive spindle and said driver free of operative engagement with said outer drive spindle for the lock in said locked position;

a spring intermediate said second end of said driver and said outer drive spindle for yielding resisting said reciprocating movement of said driver from said unlocked to said locked position;

a push actuator concentrically mounted on the first axis and interior said outer drive spindle, and said push actuator generally tubular in cross-section and having a first end operatively engaging said second end of said driver and a second end spaced from said first end;

a solenoid mounted in regions adjacent said inner lever handle and having a push rod for reciprocating motion along the first axis, and said push rod having an outer end, said solenoid having a normal, unenergized condition and an energized condition wherein electrical power is applied to said solenoid in said energized condition;

a retaining clip coupled to said outer end of said push rod for reciprocating motion therewith, and said retaining clip operatively engaging said second end of said push actuator for the lock in both the locked and the unlocked position.

2. The arrangement defined in claim 1 wherein:

said push rod is retracted in said solenoid for said solenoid in the unenergized condition to provide the lock on the unlocked condition, and said push rod is extended from said solenoid for the solenoid in the energized condition to provide the lock in the locked condition thereof.

3. The arrangement defined in claim 1 wherein:

said push rod is extended from said solenoid for said solenoid in the unenergized condition to provide the lock on the locked condition, and said push rod is retracted into said solenoid for the solenoid in the energized condition to provide the lock in the unlocked condition thereof.

4. The arrangement defined in claim 2 wherein:

said first portion of said outer surface of said driver is a double "D" geometric configuration;

said tab portion of said outer drive spindle is said double "D" geometric configuration;

said tab portion of said outer lever spindle is said double "D" geometric configuration.

5. The arrangement defined in claim 3 wherein:

said first portion of said outer surface of said driver is a double "D" geometric configuration;

said tab portion of said outer drive spindle is said double "D" geometric configuration;

said tab portion of said outer lever spindle is said double "D" geometric configuration.

6. The arrangement defined in claim 2 and further comprising:

a retractor spring in the latch arrangement resiliently resisting retraction of the latch.

7. The arrangement defined in claim 3 and further comprising:

a retractor spring in the latch arrangement resiliently resisting retraction of the latch.

8. The arrangement defined in claim 6 and further comprising:

a flange portion on said outer drive spindle operatively engaging the latch arrangement for retracting the latch against the biasing of said retractor spring.

9. The arrangement defined in claim 7 and further comprising:

a flange portion on said outer drive spindle operatively engaging the latch arrangement for retracting the latch against the biasing of said retractor spring.

10. The arrangement defined in claim 8 and further comprising:

a key cylinder mounted in said outer lever;

a key spindle concentrically mounted about and for rotation about the first axis and having a flange portion for operatively engaging the latch arrangement to retract the latch against the biasing of the said latch spring, wherein a key is insertable into said key cylinder and causes operative engagement with said key spindle to rotate said key spindle about the first axis to retract the latch.

11. The arrangement defined in claim 9 and further comprising:

a key cylinder mounted in said outer lever;

a key spindle concentrically mounted about and for rotation about the first axis and having a flange portion for operatively engaging the latch arrangement to retract the latch against the biasing of the said latch spring wherein a key is insertable into said key cylinder and causes operative engagement with said key spindle to rotate said key spindle about the first axis to retract the latch.

12. The arrangement defined in claim 10 and further comprising:

an inner drive spindle concentrically mounted on the first axis for rotation thereabout, and said inner drive spindle having a flange portion for operatively engaging the latch arrangement to retract the latch against the biasing of said retractor spring for rotation of the inner drive spindle, and said inner drive spindle operatively connected to said inner handle for rotation therewith.

13. The arrangement defined in claim 11 and further comprising:

an inner drive spindle concentrically mounted on the first axis for rotation thereabout, and said inner drive spindle having a flange portion for operatively engaging the latch arrangement to retract the latch against the biasing of said retractor spring for rotation of the inner drive spindle, and said inner drive spindle operatively connected to said inner handle for rotation therewith.

14. The arrangement defined in claim 12 wherein:

said first portion of said outer surface of said driver is a double "D" geometric configuration;

said tab portion of said outer drive spindle is said double "D" geometric configuration;

said tab portion of said outer lever spindle is said double "D" geometric configuration.

15. The arrangement defined in claim 13 wherein:

said first portion of said outer surface of said driver is a double "D" geometric configuration;

said tab portion of said outer drive spindle is said double "D" geometric configuration;

said tab portion of said outer lever spindle is said double "D" geometric configuration.

* * * * *